US010966516B2

(12) United States Patent
Hohlbein et al.

(10) Patent No.: US 10,966,516 B2
(45) Date of Patent: Apr. 6, 2021

(54) TOOTHBRUSH WITH LIGHT TRANSMISSIVE HANDLE

(71) Applicant: Colgate-Palmolive Company, New York, NY (US)

(72) Inventors: Douglas Hohlbein, Hopewell, NJ (US); Chi Shing Wong, Warren, NJ (US)

(73) Assignee: Colgate-Palmolive Company, New York, NY (US)

( * ) Notice: Subject to any disclaimer, the term of this patent is extended or adjusted under 35 U.S.C. 154(b) by 401 days.

(21) Appl. No.: 15/525,726

(22) PCT Filed: Nov. 10, 2014

(86) PCT No.: PCT/US2014/064719
§ 371 (c)(1),
(2) Date: May 10, 2017

(87) PCT Pub. No.: WO2016/076819
PCT Pub. Date: May 19, 2016

(65) Prior Publication Data

US 2017/0318955 A1 Nov. 9, 2017

(51) Int. Cl.
*A46B 15/00* (2006.01)
*B25G 1/10* (2006.01)
*A46B 9/04* (2006.01)

(52) U.S. Cl.
CPC ..... *A46B 15/0087* (2013.01); *A46B 9/04* (2013.01); *B25G 1/10* (2013.01); *A46B 2200/1066* (2013.01)

(58) Field of Classification Search
CPC .. A46B 5/02; A46B 5/026; A46B 9/04; A46B 15/0087; A46B 15/0085;
(Continued)

(56) References Cited

U.S. PATENT DOCUMENTS 2,917,057 A 12/1959 Busseuil
5,956,799 A * 9/1999 Panaccione ..... A47L 13/022 15/143.1
(Continued)

FOREIGN PATENT DOCUMENTS

DE 42 23 697 1/1993
DE 19858102 A1 * 6/2000 ..... A46B 5/02
(Continued)

OTHER PUBLICATIONS

Computer generated English translation of DE 19858102 A, Zahoransky et al., published Jun. 2000. (Year: 2000).*
(Continued)

*Primary Examiner* — Laura C Guidotti

(57) ABSTRACT

A toothbrush handle includes a support structure formed of clarified polypropylene and a body formed of thermoplastic elastomer disposed on the support structure. The support structure includes a web having a thickness in a first direction orthogonal to an axis of the toothbrush handle of less than 2 millimeters and at least one rib depending from the web and having a thickness in a second direction, orthogonal to the axis and angled relative to the first direction, of less than about 2 millimeters. The body at least partially covers the web and the at least one rib. The handle has a light transmissivity of greater than 40% through a portion of the handle at which the body covers the web and the at least one rib.

12 Claims, 3 Drawing Sheets

(58) Field of Classification Search
CPC .. B25G 1/10; B25G 1/102; B29C 2045/1689; B29L 2031/425
USPC ..... 15/143.1, 167.1; 16/902
See application file for complete search history.

(56) References Cited

U.S. PATENT DOCUMENTS

| | | | | |
|---|---|---|---|---|
| 6,367,112 | B1 | 4/2002 | Moskovich et al. | |
| 6,687,940 | B1 | 2/2004 | Gross et al. | |
| 6,919,038 | B2 | 7/2005 | Meyer et al. | |
| 6,972,106 | B2 | 12/2005 | Huber et al. | |
| 7,415,788 | B2 | 8/2008 | Little et al. | |
| 8,032,991 | B2 * | 10/2011 | Lawless | B25G 1/105 16/430 |
| 8,060,972 | B2 * | 11/2011 | Geiberger | A46B 5/02 15/143.1 |
| 8,382,208 | B2 * | 2/2013 | Baertschi | A46B 5/0025 15/143.1 |
| 8,398,326 | B2 | 3/2013 | Jimenez et al. | |
| 8,448,284 | B2 * | 5/2013 | Gross | A46B 5/02 15/143.1 |
| 8,510,893 | B2 * | 8/2013 | Wong | A46B 5/02 15/167.1 |
| D708,441 | S * | 7/2014 | Knutzen | D4/108 |
| 2006/0213018 | A1 | 9/2006 | Gross et al. | |
| 2009/0072610 | A1 | 3/2009 | Sorrentino et al. | |
| 2009/0217472 | A1 * | 9/2009 | Mueller | A46B 5/02 15/167.1 |
| 2010/0299858 | A1 | 2/2010 | Schamber et al. | |

FOREIGN PATENT DOCUMENTS

| | | | | |
|---|---|---|---|---|
| JP | 5081911 | B2 * | 11/2012 | A46B 5/02 |
| WO | WO 94/01018 | | 1/1994 | |

OTHER PUBLICATIONS

Computer generated English translation of JP 5081911 B2, Kobayashi et al., published Nov. 2012. (Year: 2012).*

International Search Report and the Written Opinion of the International Searching Authority issued in International Application PCT/US2014/064719 dated Jul. 14, 2015.

* cited by examiner

TOOTHBRUSH WITH LIGHT TRANSMISSIVE HANDLE

BACKGROUND

Functionality and aesthetics play significant roles in driving consumer demand for manual toothbrushes. Clear, or transparent, toothbrushes, especially toothbrush handles, provide a unique and oftentimes desirable aesthetic. Conventional clear toothbrushes are generally made from polymers or acrylics that maintain clarity at standard toothbrush dimensions. However, those materials tend to be more expensive than polymers generally used in manual toothbrush manufacture and may slow manufacturing throughput. For example, copolyesters have been used to make clear toothbrushes, but such materials have many drawbacks over conventionally-used polymers. Notably, copolyesters take a relatively long time to cure, lengthening the production time. Moreover, copolyesters are generally more expensive than conventional materials.

Accordingly, there is a need in the art for a toothbrush with desirable aesthetics, such as a transparent or semi-transparent appearance, but that is readily manufactured.

BRIEF SUMMARY

In aspects of this disclosure, a toothbrush handle includes a support structure formed of clarified polypropylene, the support structure comprising a web having a thickness in a first direction orthogonal to an axis of the toothbrush handle of less than 2 millimeters and at least one rib depending from the web and having a thickness in a second direction, angled relative to the first direction, of less than 2 millimeters and a body formed of thermoplastic elastomer disposed on the support structure to at least partially cover the web and the at least one rib, wherein the handle has a light transmissivity of greater than 40% through a portion of the handle at which the body covers at least a portion of the web and the at least one rib.

In one or more additional aspects, in a toothbrush handle as described in the preceding paragraph, the support structure further comprises a frame defining a void and the web extends across at least a portion of the void.

In one or more additional aspects, in a toothbrush handle as described in any of the preceding paragraphs, the at least one rib depends orthogonally from the web.

In one or more additional aspects, in a toothbrush handle as described in any of the preceding paragraphs, the web and the at least one rib extend along the axis from a position proximate an end of the handle toward a neck of the handle.

In one or more additional aspects, in a toothbrush handle as described in any of the preceding paragraphs, the light transmissivity is measured substantially along the first direction or the second direction.

In additional aspects of this disclosure, a toothbrush includes a handle and a head disposed at a distal end of the handle, wherein the handle comprises a plurality of support structures extending generally along a longitudinal axis of the handle from a position proximate a proximal end axially opposite the distal end toward the head, each of the support structures having a thickness of less than 2 millimeters in a direction orthogonal to the longitudinal axis.

In one or more additional aspects, in a toothbrush as described in the preceding paragraph, the plurality of support structures comprise a plurality of spaced-apart elongate ribs.

In one or more additional aspects, in a toothbrush as described in any of the preceding paragraphs, the support structures further comprise a web and the plurality of spaced-apart elongate ribs extend from a surface of the web.

In one or more additional aspects, in a toothbrush as described in any of the preceding paragraphs, the support structures are formed of a material having a light transmissivity of at least 85% determined using ASTM D1003.

In one or more additional aspects, in a toothbrush as described in any of the preceding paragraphs, the handle further comprises a body covering the support structures.

In one or more additional aspects, in a toothbrush as described in any of the preceding paragraphs, the body is formed from a material having a light transmissivity of at least 85% determined using ASTM D1003.

In one or more additional aspects, in a toothbrush as described in any of the preceding paragraphs, the handle has a light transmissivity of greater than 40% through a portion of the handle comprising the body covering the support structures measure substantially along the direction orthogonal to the longitudinal axis.

In additional aspects of this disclosure, a handle for an implement includes a support structure comprising at least one support member extending generally along a longitudinal axis of the handle, the support structure being formed of a first material, and a body disposed on the support structure to cover at least part of the at least one support member, the body being formed of a second material, wherein the handle is at least translucent along a sight line passing through the body and the support structure orthogonal to the longitudinal axis.

In one or more additional aspects, in a handle as described in the preceding paragraph, both the first material and the second material have a light transmissivity of at least 85% determined using ASTM D1003.

In one or more additional aspects, in a handle as described in any of the preceding paragraphs, at least one of the first material is a clarified polypropylene or the second material is a thermoplastic elastomer.

In one or more additional aspects, in a handle as described in any of the preceding paragraphs, the at least one support structure has a thickness in the direction orthogonal to the longitudinal axis of less than 2 millimeters.

In one or more additional aspects, in a handle as described in any of the preceding paragraphs, the at least one elongate support structure comprises a web and a plurality of ribs extending from a surface of the web.

In one or more additional aspects, in a handle as described in any of the preceding paragraphs, the support structure comprises a plurality of elongate ribs angled relative to each other to form a corrugated structure.

In one or more additional aspects, in a handle as described in any of the preceding paragraphs, the at least translucent portion has a visible light transmittance of at least 40%.

In one or more additional aspects, in a handle as described in any of the preceding paragraphs, the body is overmolded onto the support structure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

This disclosure relates generally to handles for implements, and more specifically to configurations of a handle for an oral care implement, such as a toothbrush handle. The following detailed description may generally refer to embodiments of a handle as part of a toothbrush, but this disclosure is not limited to use of a handle as a toothbrush handle. Other implements, including but not limited to oral care implements, may incorporate features of this disclosure. In particular implementations, handles according to this disclosure may include transparent or translucent sections.

Figure 1:
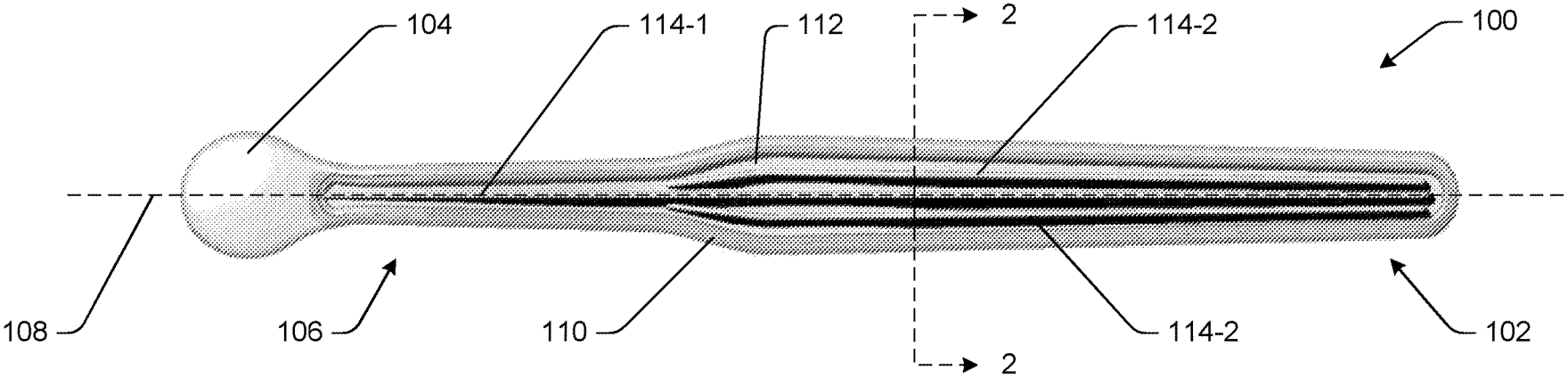
FIG. 1 is a top, plan view of a toothbrush according to an example implementation of this disclosure.
Figure 2:
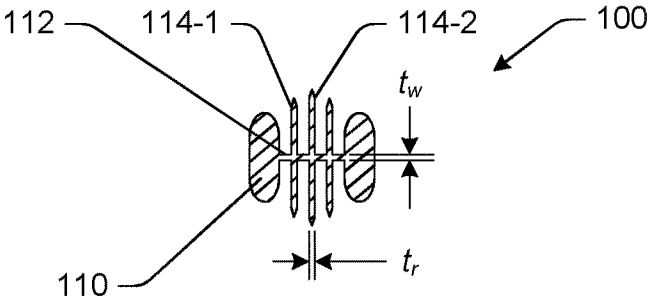
FIG. 2 is a cross-sectional view of the toothbrush of FIG. 1, taken along section line 2-2 in FIG. 1 and rotated 90-degrees about a longitudinal axis of the toothbrush.

FIGS. 1 and 2 illustrate a toothbrush 100 according to a first implementation of this disclosure. The toothbrush 100 generally includes a handle 102, a head 104 (which may support bristles, not shown) disposed of the distal end of the handle 102 and a neck portion 106 generally between the handle 102 and the head 104. As illustrated, the handle has a generally elongate shape, extending along an axis 108. This disclosure is not limited to the shape and/or size of the toothbrush 100 illustrated in FIGS. 1 and 2. In alternative implementations, one or more of the handle 102, head 104, and/or neck 106 may have different shapes, sizes, orientations, and/or the like. Additional features may also be incorporated into the toothbrush or disposed on the toothbrush.

As illustrated, the handle 102 generally includes a frame 110, which provides an outer periphery of the handle 102 and defines an inner void or opening. A web 112 extends between sections of the frame 110, generally along the direction of the axis 108, and expands across the void. In this embodiment, the web 112 occludes the void completely, although in other embodiments, the web 112 may fill less than the entire void. For example, holes (not illustrated) may be formed through the web 112 to aid in some manufacturing processes, an example of which will be provided below.

As also illustrated in FIGS. 1 and 2, a plurality of elongate fins or ribs 114 (illustrated as a central rib 114-1 and two outer ribs 114-2) depend from the web 112 and extend generally parallel to the axis 108 from a position proximate an end opposite the head 104 toward the head 104. In this example, the ribs 114 extend perpendicularly from opposite sides of the web 112. (As used herein, "perpendicular" and similar terms should be understood to include slight variations, such as things that are "substantially perpendicular.") As will be appreciated, the ribs 114 may extend at angles other than 90-degrees. Although three ribs 114 are illustrated as extending from each side of the web 112, more or fewer ribs 114 may alternatively be provided on one or both sides of the web 112. As also illustrated in FIG. 1, the ribs 114 may extend different lengths, i.e., along the axis 108. In the illustrated example, the central rib 114-1 is longer than the other ribs 114-2, extending further along the neck 106, closer to the head 104. In other implementations, all of the ribs 114 may be the same length, or they could all be different lengths. The ribs 114 may each have the same height relative to the web 112 or the height may vary from rib to rib. For example, the central rib 114-1 may be taller than the outer ribs 114-2 to provide a crowned or similar profile across the width of the toothbrush 100, as shown in FIG. 2. Alternatively, or in addition, the height of one or more of the ribs 114 may vary along its length. As illustrated in FIG. 1, the ribs may be straight along their length or they may be contoured. In this example, the central rib 114-1 is generally straight, extending parallel to the axis 108 of the toothbrush 100, whereas the outer ribs 114-2 on either side of the central rib 114-1 more closely follow the contour of the frame 110. More specifically, at the end of the handle 102 opposite the head 104, the ribs are generally closer to each other with the outer ribs 114 gradually tapering away from the central rib before tapering back towards the central rib proximate the neck 106. As will be appreciated by those having skill in the art with the benefit of this disclosure, the number, height, contour, and other attributes of the ribs may be varied to provide different aesthetic and functional benefits.

In FIGS. 1 and 2, a thickness of each of the web 112 and the ribs 114 may be minimized. In FIG. 2, the thickness of the web 112 is indicated as $t_w$ and the thickness of the ribs 114 is indicated as $t_r$. In this example, the thickness $t_w$ is measured in a first direction orthogonal to the axis 108 in and the thickness $t_r$ is measured in a second direction, also orthogonal to the axis 108, but angled (e.g., by 90-degrees) relative to the first direction. By minimizing their thicknesses, the web 112 and the ribs 114 may be substantially transparent when viewed along a line of sight parallel to the first and second directions, respectively. More specifically, with some materials, as $t_w$ decreases, more light incident on the web will be transmitted through the web 112. Likewise, as $t_r$ decreases, more light incident on each of the ribs will be transmitted through the ribs 114.

In one example implementation, the toothbrush 100 may be formed from a material having a light transmittance of 85% or more (determined per ASTM D1003). Clarified polypropylene is an example of such a material. Clarified polypropylene provides increased visible light transmission over non-clarified polypropylene, particularly at decreased thicknesses. Thus, in the embodiment illustrated in FIGS. 1 and 2, by minimizing the thickness of the web 112 and the ribs 114, the structure created by the web 112 and the ribs 114 (i.e., in the void) allows more light through than the relatively thicker areas, e.g., the outer frame 110 and the head 104. Along viewing angles normal to the web and the ribs, the structure is substantially transparent. In some implementations, the web 112 and the ribs 114 have a thickness of less than 2 millimeters and in other embodiments less than 1 millimeter to achieve better light transmittance. As noted above, the thickness of the web 112 and the ribs 114 will affect the light transmission properties of the toothbrush. Other factors, such as the type and amount of clarifier used in the polypropylene and/or other additives, such as dyes or the like, may also affect light transmissivity.

Some presently preferred embodiments allow for at least 80% transmittance of light at wavelengths of 410-800 nanometers (i.e., in the visible light spectrum) through portions of the toothbrush 100. For instance, along a sight line normal to the web, the toothbrush will have a transmittance of 80% or greater. For purposes of this disclosure, as long as one wavelength in the visible light range has greater than 80% transmittance, the toothbrush 100, is substantially transparent. In other embodiments, toothbrushes in accordance with this disclosure will have a light transmittance of at least 85-90% for light at a wavelength of 410-800 nanometers. For purposes of this disclosure, as long as one wavelength in the visible light spectrum has transmittance greater than a designated amount at any location on the toothbrush, the toothbrush is considered to have a transmittance of at least that amount in the visible light spectrum. Some embodiments allow for at least 40% transmittance of light in the visible light spectrum through substantially all portions of the toothbrush at angles normal to the axis.

Light transmissivities described herein may be measured using a spectrophotometer using known techniques. For example, ASTM D1003 describes a technique for measuring light transmissivity through transparent plastics. Although that test is intended for materials having a standard size and shape, similar techniques may be used to measure transmissivity through the toothbrush.

The material may also be chosen to limit haze. Haze may also be determined using ASTM D1003, and the material used to manufacture the toothbrush 100 may have a haze value of less than 25%.

A number of benefits may be realized by using the clarified polypropylene over conventional clear acrylics or other materials. For instance, clarified polypropylene is generally cheaper than materials conventionally used to make clear parts. Moreover, manufacturing and handling the clarified polypropylene may be easier. Some conventional materials would require longer curing times to form a part like a toothbrush, thus increasing production throughput. Moreover, polypropylene may be readily amenable to further processing. In the example of FIG. 1, the entire toothbrush 100 is formed as a unitary piece. When that piece is formed of clarified polypropylene, post-processes, such as application of bristles to the head 104, may be done using conventional techniques.

In the example of FIGS. 1 and 2, the toothbrush 100 may be a single, unitary part, e.g., formed from a single mold from a single material—clarified polypropylene in one example. More light will be transmitted through the web 112 and the ribs 114 (along a sight line normal to such features, respectively) than through the frame 110 and the head 104, because the frame and the head are substantially thicker. Thus, the toothbrush 100 will appear substantially transparent along some sight lines, e.g., sight lines normal to the web, and more translucent along other sight lines, e.g., sight lines at other angles, through thicker areas, or through multiple features. In other embodiments, the thickness of the outer frame 110 could be decreased, e.g., to appear more like another rib 114, which could result in even greater light transmission along sight lines normal to the ribs, passing through the outer frame. Such a design may be less comfortable for a user, but could provide a more light-transmissive aesthetic.

In certain embodiments, the head 104 may comprise a plate having a plurality of holes formed therethrough, and tooth cleaning elements may be mounted to the plate within the holes. This type of technique for mounting the tooth cleaning elements to the head 104 via a head plate is generally known as anchor free tufting (AFT). Specifically, in AFT a plate or membrane is created separately from the head 104. The tooth cleaning elements (such as bristles, elastomeric elements, and combinations thereof) are positioned into the head plate so as to extend through the holes of the head plate. The free ends of the tooth cleaning elements on one side of the head plate perform the cleaning function. The ends of the tooth cleaning elements on the other side of the head plate are melted together by heat to be anchored in place. As the tooth cleaning elements are melted together, a melt matte is formed, which is a layer of plastic formed from the collective ends of the tooth cleaning elements that connects the tooth cleaning elements to one another on one side of the head plate and prevents the tooth cleaning elements from being pulled through the tuft holes.

After the tooth cleaning elements are secured to the head plate, the head plate is secured to the head 104 such as by ultrasonic welding. When the head plate is coupled to the head 104, the melt matte is located between a lower surface of the head plate and a floor of a basin of the head 104 in which the head plate is disposed. The melt matte, which is coupled directly to and in fact forms a part of the tooth cleaning elements, prevents the tooth cleaning elements from being pulled through the holes in the head plate thus ensuring that the tooth cleaning elements remain attached to the head plate during use of the oral care implement 100.

In another embodiment, the tooth cleaning elements may be connected to the head 104 using a technique known in the art as AMR. In this technique, the handle is formed integrally with the head plate as a one-piece structure. After the handle and head plate are formed, the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner (the structure can just be a plastic material that is used to form a smooth rear surface of the head, or the like, and the structure can be molded onto the rear surface of the head plate or snap-fit (or other mechanical coupling) to the rear surface of the head plate as desired).

Of course, techniques other than AFT and AMR can be used for mounting tooth cleaning elements to the head 104, such as widely known and used stapling/anchoring techniques or the like. In such embodiments the head plate may be omitted and the tooth cleaning elements may be coupled directly to the head 104. Furthermore, in a modified version of the AFT process discussed above, the head plate may be formed by positioning the tooth cleaning elements within a mold, and then molding the head plate around the tooth cleaning elements via an injection molding process. However, it should be appreciated that certain of the bristle tufts disclosed herein cannot be adequately secured to the head using staple techniques, and one of AFT or AMR is therefore use for securing such bristle tufts (i.e., the conical tufts described below) to the head.

Although described herein above with regard to using AFT, in certain embodiments any suitable form of cleaning elements and attachment may be used in the broad practice of this invention. Specifically, the tooth cleaning elements of the present invention can be connected to the head 104 in any manner known in the art. For example, staples/anchors or in-mold tufting (IMT) could be used to mount the cleaning elements/tooth engaging elements. In certain embodiments, the invention can be practiced with various combinations of stapled, IMT, AMR, or AFT bristles. Alternatively, the tooth cleaning elements could be mounted to tuft blocks or sections by extending through suitable openings in the tuft blocks so that the base of the tooth cleaning elements is mounted within or below the tuft block.

Although not illustrated herein, in certain embodiments the head 104 may also include a soft tissue cleanser coupled to or positioned on its rear surface. An example of a suitable soft tissue cleanser that may be used with the present invention and positioned on the rear surface of the head 104 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of one or more ridges (elongated transverse, longitudinal, angled), nubs, or combinations thereof. Of course, the invention is not to be so limited and in certain embodiments the oral care implement 100 may not include any soft tissue cleanser.

Figure 3:
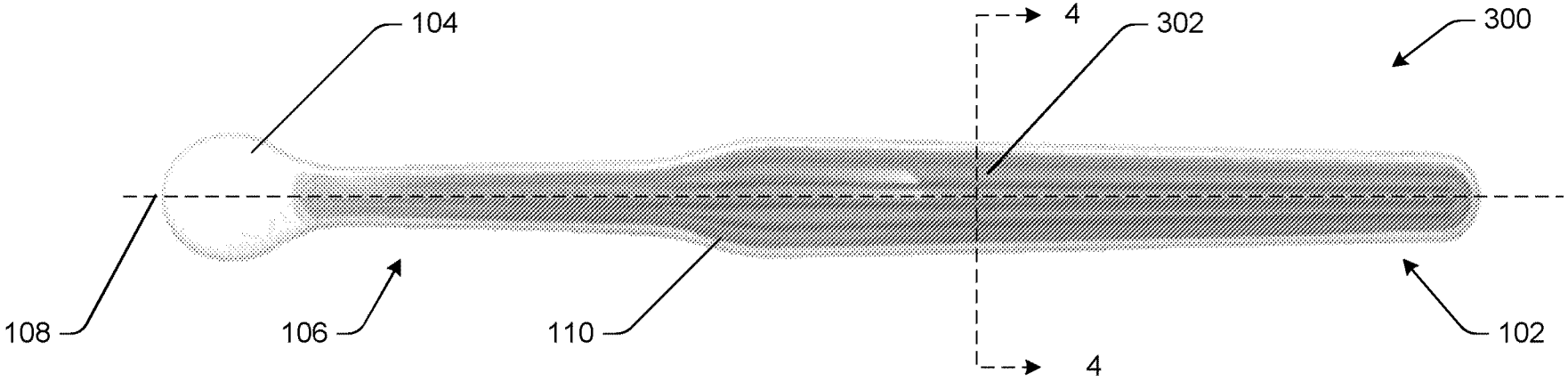
FIG. 3 is a top, plan view of a toothbrush according to an example implementation of this disclosure.
Figure 4:
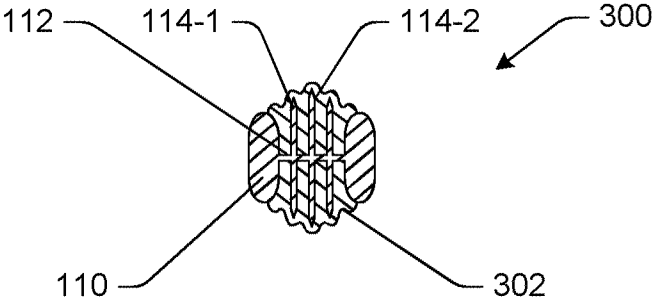
FIG. 4 is a cross-sectional view of the toothbrush of FIG. 3, taken along section line 4-4 in FIG. 3 and rotated 90-degrees about a longitudinal axis of the toothbrush.

Generally, in FIGS. 1 and 2 the web 112 and the ribs 114 may act as support members that collectively form a support structure. The support structure preferably provides stability and a degree of rigidity to the handle 102 for comfortable and effective manual manipulation. FIGS. 3 and 4 illustrate another embodiment of this disclosure, in which the support structure supports a body, which may be molded over a portion of the handle.

More specifically, FIGS. 3 and 4 illustrate a toothbrush 300 that is substantially the same as the toothbrush 100 (and the same reference numerals are used to identify common components) and further includes a body 302 formed over a portion of the handle 102 and neck 106. In this example, the body 302 is disposed to completely cover the web 112 and the ribs 114, on both sides (i.e., the top and bottom) of the toothbrush. The body may be formed to take generally any outer shape and profile, and the dimensions of the body may vary at different positions along the toothbrush.

As noted above, some or all of the outer frame 110, web 112, and ribs 114 may act as a support structure to provide rigidity to the toothbrush 300, whereas the body 302 may be chosen to provide a different aesthetic, e.g. to mask the ribs, and/or to provide a different manual gripping surface, e.g., to alter control, comfort, and/or handling. For example, a material having a hardness value of between about 15 and about 90 Shore-A may be selected for its tactile comfort. A low-haze material may also be selected, for its visual aesthetic. For example, a material having a haze value of less than 10% and more preferably less than 5% may be chosen as the material for the body.

While a number of conventional materials may be used for the body, in some embodiments the body 302 is made from a material having a light transmittance of 85% or more (determined per ASTM D1003). By way of non-limiting example, the body 302 may be made from a thermoplastic elastomer (TPE) or thermoplastic polymer. TPE having a light transmittance of 90% or higher (determined per ASTM D1003) is commercially available. Moreover, TPE can be readily manufactured, such as through conventional molding, e.g., injection molding, processes, and some TPEs have a haze value of less than about 5%. A suitable TPE for the body 302 may be based on polyolefin-based polymers, styrene block copolymers, and/or a blend of the two.

As will be appreciated, when a light transmissive material is used for the body, such as the TPE described above, the overall effect will be a handle that transmits visible light, because both the underlying support structure 100 and the body 302 transmit visible light. The transmissivity of visible light will vary along the toothbrush, e.g., depending upon the thicknesses of the body and the support structure. For example, visible light passing through the neck of the toothbrush along a line of sight normal to the web will have a relatively high transmissivity, and that portion of the toothbrush may be substantially transparent. In contrast, less visible light will pass through the toothbrush along a line of sight that passes through the outer frame 110 and the body 302. However, because the toothbrush 300 is made from two materials, each having light transmissivity of 85% or higher, some light will pass through the structures made of these materials at conventional toothbrush sizes. Toothbrushes made according to aspects of this disclosure may allow for at least 40% transmittance of light, more preferably 50% transmittance of light, at wavelengths of 410-800 nanometers (i.e., in the visible light spectrum) along substantially any sight line normal to the axis and passing through both the support structure and the body.

The toothbrushes 100, 300 described above may be manufactured using conventional molding techniques, including but not limited to injection molding. In one example implementation, the toothbrush 100 may be formed in a single mold, as a single shot. In another embodiment, the toothbrush 100 may be formed in two shots, for example, a first shot to create the support structure and a second shot to create the relatively thicker features, e.g., the outer frame 110 and the head 104. In this example, the second shot may be a different material than the first shot, which may provide additional functionality. For instance, the second shot could be an opaque material, in which case only the area in the void would be at least translucent. Such an arrangement may provide a different aesthetic.

When the body 302 is included, as in the toothbrush 300, the material comprising the body may be overmolded on the toothbrush 100 as support structure. In some embodiments, the body 302 may be formed in a single shot. As one way to promote such a process, holes or the like may be formed in the web 114, e.g., to allow the material forming the body to pass through to both sides (i.e., the top and bottom) of the toothbrush. In other embodiments, the body 302 may be formed as two or more shots, e.g., a first shot for the body on a first side of the web 112 and a second shot for the body on the other side of the web.

According to embodiments of this disclosure, it may be desirable to control the finish on external surfaces of the toothbrush, e.g., to reduce haze. In some examples the TPE body 302 may have a polished surface finish, such as an SPI-A1 or SPI-A2 finish. Such a finish may be achieved by controlling aspects of the molding process. Alternatively, a light surface texture may be applied on the tool to aid in demolding while maintaining a high quality surface. In some embodiments, ejector pins may be staged in the mold, e.g., along the axial direction of the toothbrush, to promote part removal. Ejectors or knock out pins may iteratively de-mold the part along the axial length, to break any vacuum formed between the part and the mold, essentially peeling the mold from the part. Bristles and/or other cleaning implements may also be integrated into the toothbrush 100, 300 after molding.

Figure 5:
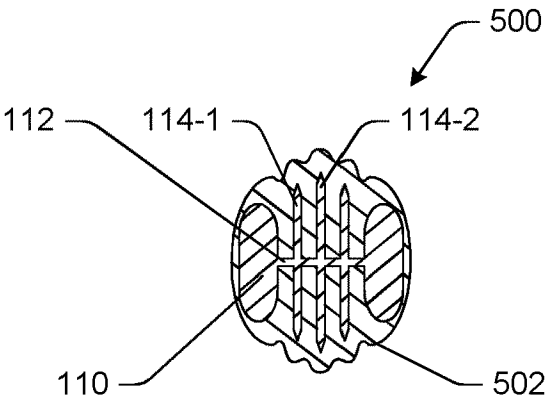
FIG. 5 is a cross-sectional view of a toothbrush according to an example implementation of this disclosure.

The body 302 preferably has good light transmission properties and may advantageously be chemically compatible with the support structure. The body 302 may also take any of a number of shapes, profiles, or appearances. For example, FIG. 5 shows a cross section of another example toothbrush 500 in which a body 502 is formed to completely encapsulate the support structure. Unlike the body 302 described above, which was formed laterally between the outer frame 110 to leave a portion of the outer frame 110 exposed, the body 502 leaves none of the outer frame 110 exposed. In an alternative to this example, the outer frame 110 may be manufactured to be thinner, e.g., to have a thickness comparable to the ribs, to enhance light transmission through the outer frame. In such an example, the toothbrush may be transparent or semi-transparent when viewed from a side, as well as when viewed from the top or bottom.

Although not illustrated in FIG. 5, the body 502 may extend axially along the toothbrush 500 any distance. For example, the body 502 may be formed only over the portion of the handle that includes the web and/or ribs or it could extend any distance beyond. In still other embodiments, the ribs may be partially exposed. Moreover, the body 502 may be formed such that some or all of the support structure, e.g., the outer frame, is exposed proximate the end of the toothbrush opposite the head, or such that all the outer frame is encapsulated.

Figure 6:
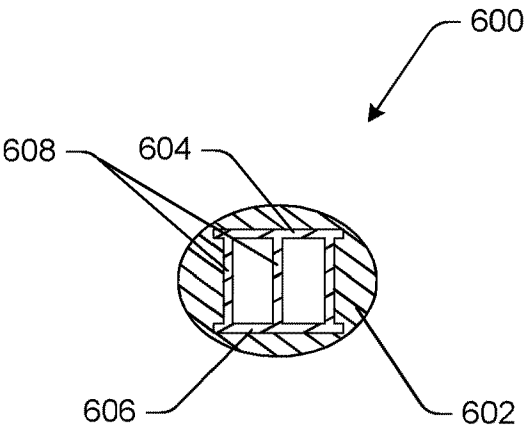
FIG. 6 is a cross-sectional view of a toothbrush according to an example implementation of this disclosure.

Other configurations of the toothbrush 100, 300, 500 also are contemplated. For example, FIG. 6 illustrates a toothbrush 600 having a body 602 disposed on a support structure having a cross section different from those described above. The support structure generally includes two (e.g., top and bottom) planar members 604, 606 connected by longitudinally extending ribs 608. The surfaces 604, 606 and the extending ribs 608 form a support structure for the body 602, similar to the embodiments discussed above. As with previously described embodiments, the surfaces 604, 606 and the extending ribs 608 preferably are thin enough to allow light transmission therethrough. When clarified polypropylene is used to form the support structure, the surfaces 604, 606 and extending ribs 608 may be about two millimeters thick or thinner. In other embodiments, the thickness may be one millimeter or less.

Although the body 602 is illustrated as encapsulating the support structure, in other embodiments the body may cover less. For example it may be formed only on the top and/or bottom surfaces of the structure, as in the toothbrush 300, described above. In some embodiments, the surfaces 604, 606 and ribs 608 may be disposed between an outer frame.

Figure 7:
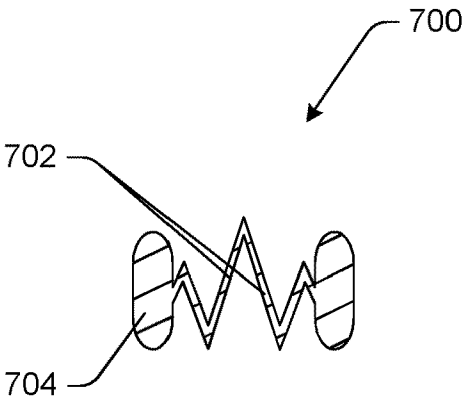
FIG. 7 is a cross-sectional view of a toothbrush according to an example implementation of this disclosure.

Another example embodiment is illustrated in FIG. 7. Like other embodiments, FIG. 7 shows a cross-section of a handle 700. A support structure in this embodiment includes a plurality of ribs 702 extending between an outer frame 704. The outer frame may take the form of the outer frame 110 described above. The ribs 702 in this example constitute a plurality of support members that together form a corrugated profile. As with embodiments described above, a body may be disposed over some or all of the support structure. Moreover, the outer frame may not be necessary.

In each of the examples provided, the support structure includes one or more relatively thin-walled sections, which have higher light transmissivity than relatively thicker sections. When a light-transmissive body is provided over the support structure, the result is a handle having improved light transmission. Although an amount of light transmission will vary along the handle (e.g., based on material thicknesses), some example implementations may allow for at least 40% transmittance of light, more preferably 50% transmittance of light, at wavelengths of 410-800 nanometers (i.e., in the visible light spectrum) along substantially any sight line passing through both the support structure and the body.

Although example embodiments have been described in language specific to the structural features and/or methodological acts, the claims are not necessarily limited to the specific features or acts described. Rather, the specific features and acts are disclosed as illustrative forms of implementing the example embodiments.

What is claimed is:

1. A toothbrush handle comprising:

a support structure formed of clarified polypropylene, the support structure comprising a web having a thickness in a first direction orthogonal to a longitudinal axis of the toothbrush handle of less than 2 millimeters between first and second sides of the web and a plurality of ribs depending from the first and second sides of the web, the plurality of ribs extending parallel to the first direction and having a thickness in a second direction perpendicular to the first direction of less than 2 millimeters; and a body formed of thermoplastic elastomer disposed on the support structure to at least partially cover the web and the plurality of ribs;

wherein the plurality of ribs comprises a central rib and at least one outer rib, the central rib being longer than the outer rib along the longitudinal axis.

2. The toothbrush handle of claim 1, wherein the handle comprises a a neck and a gripping region, the neck coupled to a distal end of the gripping region, the central rib extending from the head to a proximal end of the gripping region, and the at least one outer rib extending from a distal end of the neck to the proximal end of the gripping region.

3. The toothbrush handle of claim 1, wherein the web lies in a first plane coincident with the longitudinal axis, the first direction perpendicular to the first plane.

4. The toothbrush handle according to claim 1, wherein the central rib of plurality of ribs has a height which is greater than a height of the at least one outer rib as measured from the web to a distal end of each of the central rib and the at least one outer rib.

5. The toothbrush handle of claim 1, wherein the plurality of ribs further comprises a second central rib, the central rib extending in the first direction and the second central rib extending in a direction opposite the first direction, the central rib and the second central rib being coplanar.

6. The toothbrush handle of claim 1, wherein the central rib extends from the first side of the web and a second central rib extends from the second side of the web.

7. A toothbrush comprising:

a handle; and a head connected to a distal end of the handle by a neck, wherein the handle comprises a plurality of support structures extending generally along a longitudinal axis of the handle from a position proximate a proximal end axially opposite the distal end toward the head, each of the support structures having a thickness of less than 2 millimeters in a direction orthogonal to the longitudinal axis;

wherein the plurality of support structures comprise a plurality of spaced-apart elongate ribs that include a central rib and at least one outer rib, the central rib extending from the head to a proximal end of the handle and the outer rib extending from a distal end of the handle to the proximal end of the handle.

8. The toothbrush of claim 7, wherein the support structures further comprise a web and the plurality of spaced-apart elongate ribs extend from a surface of the web in a first direction perpendicular to the longitudinal axis, the thicknesses of the spaced-apart elongate ribs measured in a direction that is orthogonal to the first direction and the longitudinal axis and the thickness of the web being measured in the first direction.

9. The toothbrush of claim 7, wherein the support structures are formed of a material having a light transmissivity of at least 85% determined using ASTM D1003.

10. The toothbrush of claim 7, wherein the handle further comprises a body covering the support structures.

11. The toothbrush of claim 10, wherein the body is formed from a material having a light transmissivity of at least 85% determined using ASTM D1003.

12. The toothbrush of claim 7, further comprising a plane coincident with the longitudinal axis, wherein the plurality of spaced-apart elongate ribs extend from the plane in a first direction perpendicular to the longitudinal axis and a second direction opposite the first direction.

* * * * *